US008613993B2

(12) United States Patent
Kuchar

(10) Patent No.: US 8,613,993 B2
(45) Date of Patent: Dec. 24, 2013

(54) EXPANDABLE WEB MATERIAL

(75) Inventor: David M. Kuchar, Metuchen, NJ (US)

(73) Assignee: Kucharco Corporation, Metuchen, NJ (US)

( * ) Notice: Subject to any disclaimer, the term of this patent is extended or adjusted under 35 U.S.C. 154(b) by 309 days.

(21) Appl. No.: 12/755,316

(22) Filed: Apr. 6, 2010

(65) Prior Publication Data

US 2010/0196633 A1 Aug. 5, 2010

Related U.S. Application Data

(60) Provisional application No. 61/260,807, filed on Nov. 12, 2009.

(51) Int. Cl.
*B32B 3/00* (2006.01)
*B32B 3/10* (2006.01)
*B32B 5/04* (2006.01)

(52) U.S. Cl.
USPC ..... 428/136; 428/131; 428/134; 428/135; 428/906; 229/87.01; 229/87.02; 229/87.03; 229/87.08

(58) Field of Classification Search
USPC ..... 428/131, 134, 135, 136, 596, 906; 229/87.01, 87.02, 87.03, 87.08; 493/967; 206/814; 256/19, 21
See application file for complete search history.

(56) References Cited

U.S. PATENT DOCUMENTS 3,655,501 A * 4/1972 Tesch ..... 428/136
3,958,751 A * 5/1976 Bruno ..... 229/87.08
4,803,128 A * 2/1989 Bender ..... 428/577
2,656,291 A 10/1993 Doll et al.
5,500,271 A * 3/1996 Pasch et al. ..... 428/135
5,538,778 A 7/1996 Hurwitz et al.
5,667,871 A 9/1997 Goodrich et al.
5,688,578 A 11/1997 Goodrich
6,929,843 B2 8/2005 Kuchar

FOREIGN PATENT DOCUMENTS

AU 199226388 A1 10/1992

* cited by examiner

*Primary Examiner* — Maria Veronica Ewald
*Assistant Examiner* — Joanna Pleszczynska
(74) *Attorney, Agent, or Firm* — Ernest D. Buff; Ernst D. Buff & Assoc. LLC; Margaret A. LaCroix

(57) ABSTRACT

The Present Invention discloses a slit web material, substantially longer than it is wide, with specially shaped slits that permit relatively easy expansion upon deployment. The specially shaped slits are referred to in the Present Application as "tilde-slits," because they resemble a tilde mark. The cuts are arranged in continuous rows of tilde-slits. In any given row, the tilde-slits follow one-after-the-other in a linear direction. Adjacent rows of slits are parallel to each other, but are offset from one another such that a line drawn between adjacent tilde-slits in adjacent rows is not perpendicular to the direction of the rows. The invention contemplates that the material dispenses from a continuous roll. If the slits are arranged in the longitudinal direction, then the web material expands in the width direction only upon deployment. However, if the slits are arranged such that the row direction is at some angle to the longitudinal direction, then the web material expands in both directions upon deployment. In this case, a special dispenser is not required, and the material expands in both directions as it is pulled off the roll prior to cutting a desired length of material from the roll.

18 Claims, 14 Drawing Sheets

EXPANDABLE WEB MATERIAL

CROSS REFERENCE TO RELATED APPLICATIONS

The Present Application is an improvement over my U.S. Pat. No. 6,929,843, entitled FENCE TAPE, and issued to me (hereinafter, the Applicant) on Aug. 16, 2005 (hereinafter, the Fence Tape Patent), which is based upon U.S. patent application Ser. No. 10/605,028 filed on Sep. 2, 2003. It is also related to U.S. Provisional Patent Application Ser. No. 61/260,807 filed on Nov. 12, 2009 by Matthew Kuchar and the Applicant, entitled APPARATUS TO DEPLOY AND EXPAND WEB MATERIAL. The Fence Tape Patent and U.S. Provisional Patent Application Ser. No. 61/269,807 are incorporated by reference herein in their entirety.

BACKGROUND OF THE INVENTION

The Fence Tape Patent discloses and claims a tape barrier consisting of flexible material having generally parallel edges and substantially greater length than width. Cuts are made into the tape at intervals along the tape, forming slits that define cross members that extend generally along the length of the tape. The slits may be completed cuts so that the cross members are free to fall away from the tape on perforations that enable the cross members to be separated from the tape by tearing along the perforations. When the tape is deployed generally horizontally, the cross members fall vertically to provide cross members along the length of the resulting tape structure.

The contemplated use of the product taught in the Fence Tape Patent is a flexible plastic barrier tape segment cut from a continuous roll of tape. The ends of the segment are affixed to two mounting elements (e.g., vertical posts). A user then grasps the bottom of the tape segment, and pulls in a horizontal direction. As a result, the tape segment expands vertically to form a lattice or fence type structure with horizontal and vertical elements that create square voids. It is important to note that the tape expands in only one direction (i.e., vertical), while the other direction (i.e., horizontal) retains a constant length. The tape expands in width only, and does not expand in the longitudinal direction.

Australian Patent Application Serial No. 199226388 A1, filed by Gregory Beaumont on Oct. 14, 1992, teaches a safety net produced from a sheet of plastic material that has been slit to produce a formation of two repeating polygon shaped openings when expanded by tensioning opposite edges. The Beaumont application contemplates use of the invention as a fence barrier.

Sheet material that produces a lattice structure when pulled from opposite sides has been around for a while. Another example of such a product is taught in U.S. Pat. No. 2,656,291 issued to Doll, et. al. on Oct. 20, 1993. Doll discloses a slit sheet that when pulled, deploys to a lattice with rhombus shaped voids. Yet another example may be found in U.S. Pat. Nos. 5,667,871 and 5,688,578, both issued to Goodrich, et. al. on Sep. 16, 1997 and Nov. 18, 1997, respectively. Goodrich discloses a slit sheet of heavy paper that when pulled in opposite directions, expands into a lattice with hexagonal voids. A companion patent to Goodrich is U.S. Pat. No. 5,538,778 issued to Hurwitz, et. al. on Jul. 23, 1996. Doll, Hurwitz, and Goodrich contemplated use of their inventions as a packing material.

The Fence Tape Patent taught a continuous roll of material cut with specially shaped slits along the entire length of the material in the longitudinal direction, and which expands into a lattice structure when pulled in a single direction. In these prior art patents, the material expands in one direction while becoming narrower in the other direction.

The Fence Tape Patent does not limit its disclosure to traditional plastic barrier tape. The patent contemplates other uses for a continuous roll of slit material that deploys into a lattice. For example, if heavy paper is used, the material may deploy directly from the continuous roll into a packing material. Expansion of the material produces a lattice structure with square or rhombus shaped voids bounded by longitudinal members and cross members. The lattice structure produced has a unique advantage. The longitudinal members reside mainly in the plane of the paper, but the cross members twist into a non-coplanar direction. Therefore, if the material is rolled around an object, the rolled surfaces will be separated by a distance equal to the non-planar dimension of the cross members.

When used for packing, much more material is required than for fence barriers, and the lattice dimensions need to be smaller. There are many more voids per unit area in the packing material than in the fence barrier. The problem with the continuous material produced with the Fence Tape Patent for use as packing material is the difficulty of deploying (i.e., expanding) a sufficient quantity of material as it comes off the roll. As the roll unravels, a user must pull on many sections in order to fully deploy the material. A single pull on the material expands it about six inches in width. Thus, a user needs to pull on the material repeatedly until it expands as desired. U.S. Provisional Patent Application Ser. No. 61/260,807 solves this problem by teaching a dispenser that expands the material to its full width as it unravels from the roll.

SUMMARY OF THE INVENTION

The Present Invention discloses a slit web material, substantially longer than it is wide, with specially shaped slits that permit relatively easy expansion upon deployment. The specially shaped slits are referred to in the Present Application as "tilde-slits," because they resemble a tilde mark. The cuts are arranged in continuous rows of tilde-slits. In any given row, the tilde-slits follow one-after-the-other in a linear direction. Adjacent rows of slits are parallel to each other, but are offset from one another such that a line drawn between adjacent tilde-slits in adjacent rows is not perpendicular to the direction of the rows. The invention contemplates that the material dispenses from a continuous roll. If the slits are arranged in the longitudinal direction, then the web material expands in the width direction only upon deployment. However, if the slits are arranged such that the row direction is at some angle to the longitudinal direction, then the web material expands in both directions upon deployment. In this case, a special dispenser is not required, and the material expands in both directions as it is pulled off the roll prior to cutting a desired length of material from the roll.

BRIEF DESCRIPTION OF THE DRAWINGS

FIG. 7 illustrates the expanded web material.

FIG. 8 shows the numeric values of the variable parameters for an exemplary embodiment of the Present Invention.

DETAILED DESCRIPTION OF THE INVENTION

Figure 1:
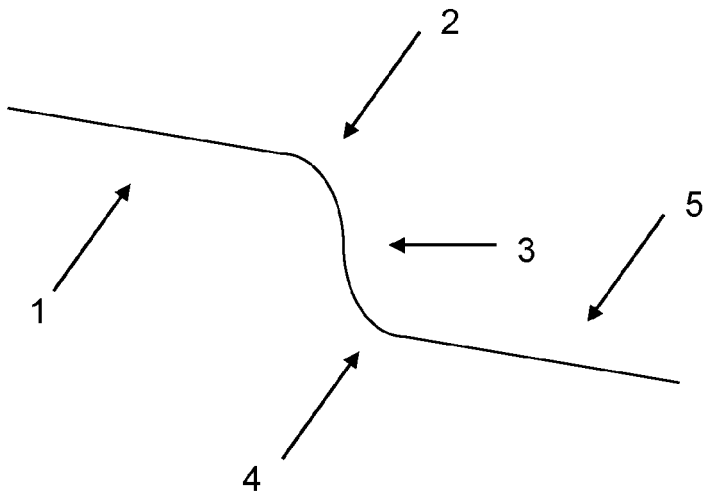
FIG. 1 illustrates the shape of a tilde-slit.
Figure 2:
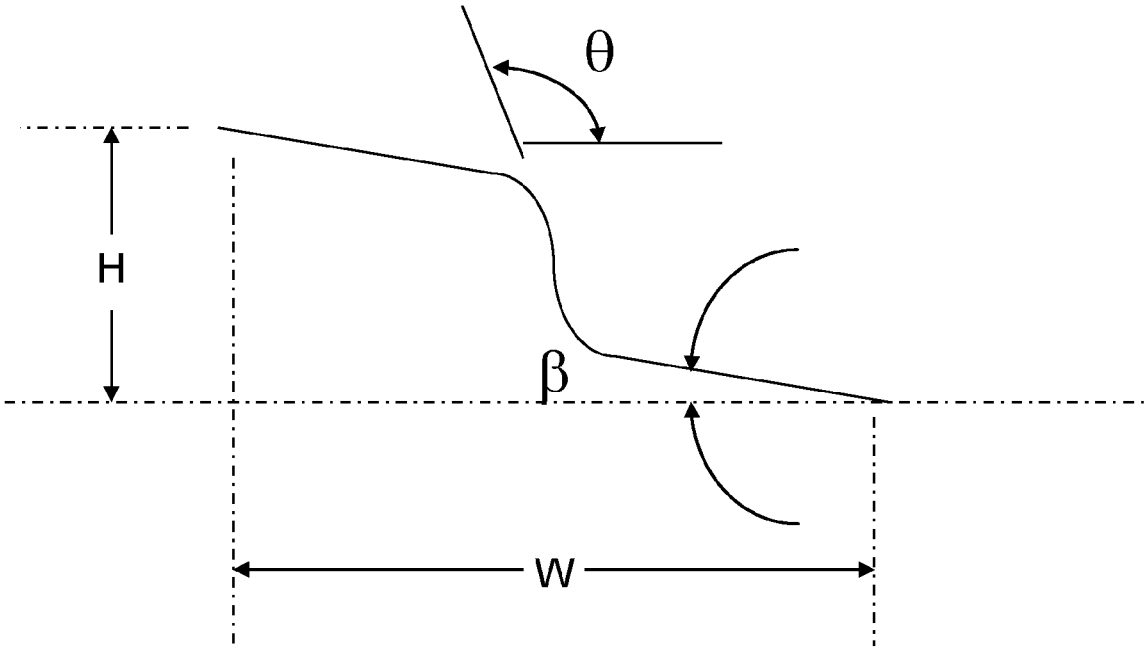
FIG. 2 illustrates variable parameters that determine the shape of the tilde-slit.

Acting as his own lexicographer, the Applicant defines the tilde-slit as having the following shape. Referring to FIG. 1 and FIG. 2, the tilde-slit has two parallel straight cuts, 1 and 5 (see FIG. 1), that are cut at an angle β to the horizontal X-axis shown in FIG. 2. A central portion 3 extends at an angle θ to the horizontal X-axis. Between straight cut 1 and central portion 3, is a curved connecting portion 2, and between straight cut 5 and central portion 3, is a reverse curve 4, where 2 and 4 are X-Y double reversed mirror images of one another. The vertical Y distance between the ends of straight cut 1 and straight cut 5 is H. The horizontal X distance between the ends of straight cut 1 and straight cut 5 is W.

Figure 3:
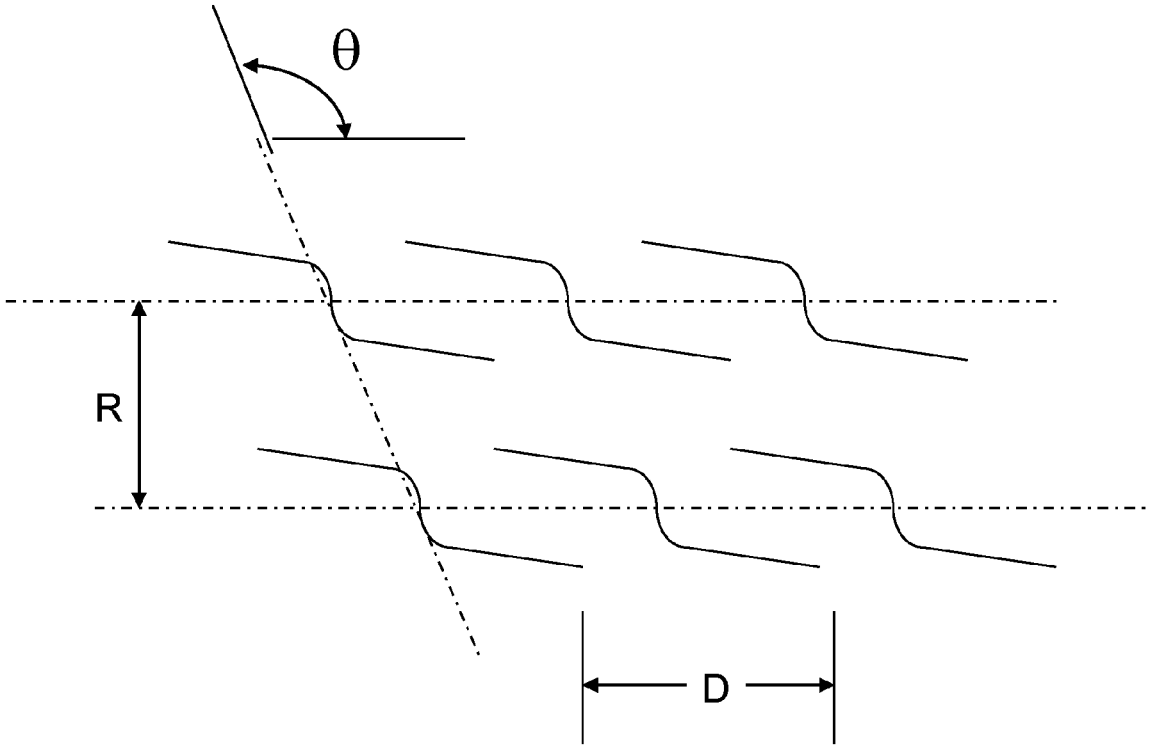
FIG. 3 illustrates two adjacent rows of tilde-slits arranged in the horizontal (or longitudinal) direction.

FIG. 3 illustrates two adjacent rows of tilde-slits. In the drawing, the two rows are parallel to each other along the horizontal X-direction. All of the tilde-slits are congruent. The centers of all of the tilde-slits in any given row lie on the same straight line. However, there is an offset of the adjacent tilde-slits between adjacent rows. As shown in FIG. 3, a transversal is drawn at an angle θ to the two horizontal parallel lines, i.e., the centerlines of the two rows. The transversal intersects both parallel lines, and passes coincident with the center portion 3 of adjacent tilde-slits. That transversal line continues in both directions coincident with the center portion 3 of every adjacent tilde-slit in every row. Needless to say, parallel transversal lines at angle θ can be drawn through the center portion of any tilde-slit, and it will be coincident with the center portions of all adjacent tilde-slits. The distance between adjacent rows is R, and the distance between tilde-slits in a given row is D.

Figure 4:
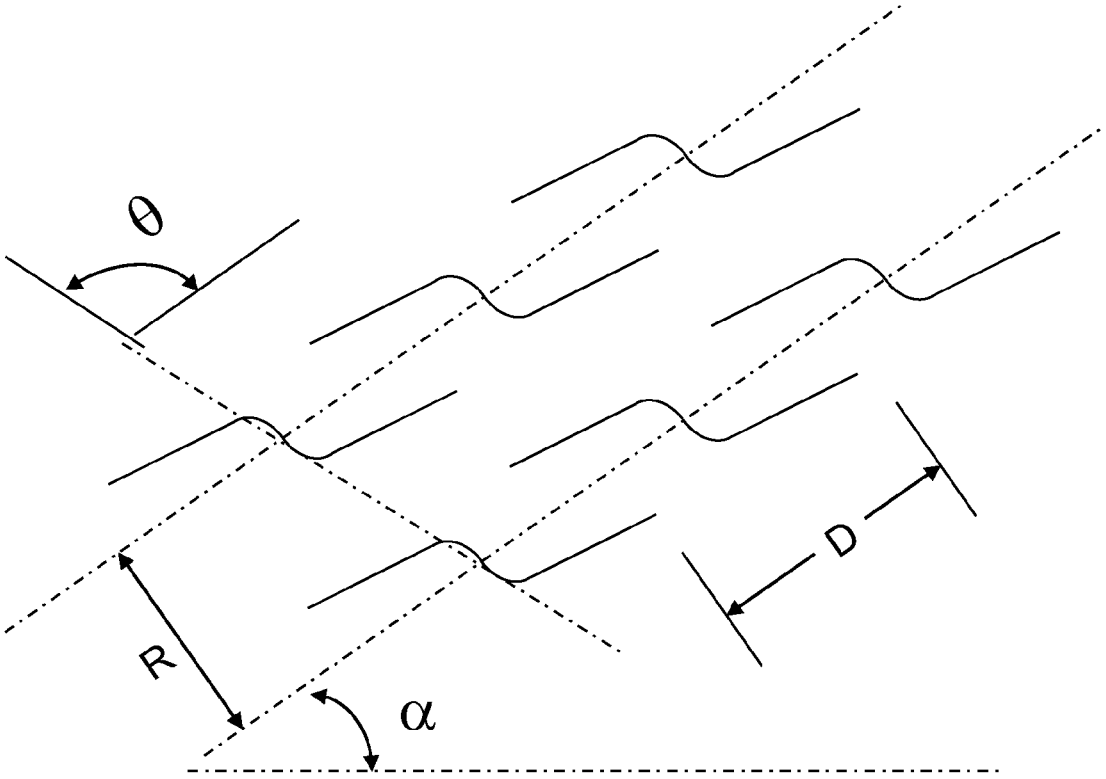
FIG. 4 illustrates two adjacent rows of tilde-slits arranged at some angle to the horizontal (or longitudinal) direction.

As discussed supra, there is an advantage to configuring the rows to run in a direction not parallel to the longitudinal direction (X-axis). If the tilde cuts are configured parallel to the longitudinal direction, expansion of the web material can only be in the width direction (Y-axis). However, if the parallel rows are configured at an angle α to the longitudinal direction (X-axis), as illustrated in FIG. 4, expansion is bi-directional. Either way, the final product is identical.

Figure 5:
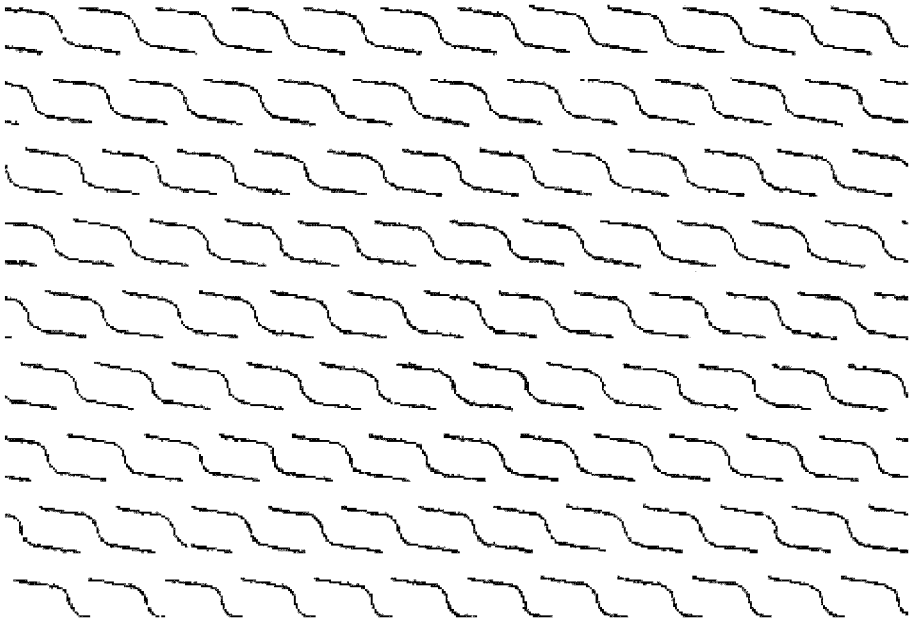
FIG. 5 illustrates a rectangular section of material with the rows of tilde-slits arranged in the horizontal (or longitudinal) direction. With this material, the slits extend to the full width of the web.
Figure 6:
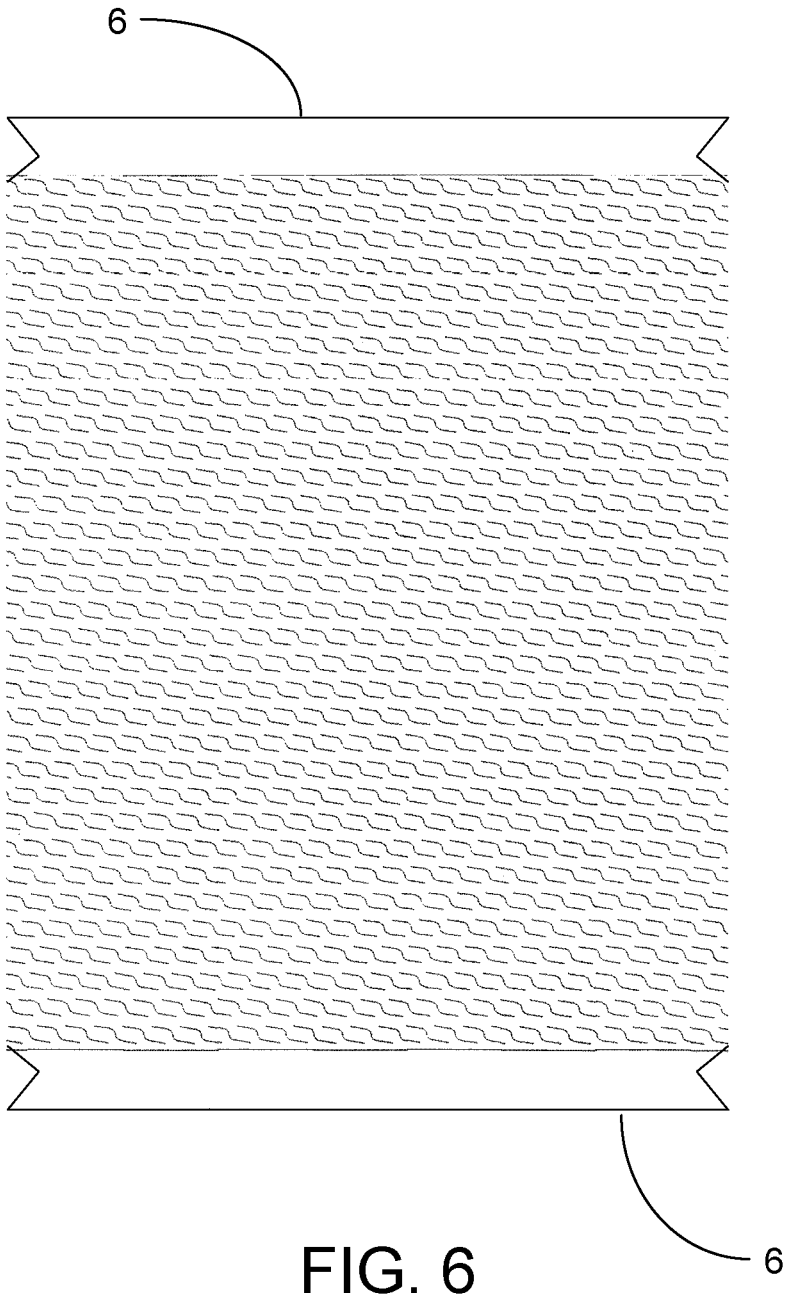
FIG. 6 illustrates a rectangular section of material with the rows of tilde-slits arranged in the horizontal (or longitudinal) direction. With this material, two borders (devoid of slits) run parallel to the longitudinal direction and are positioned on both sides of the width of the web.

FIG. 5 illustrates a portion of the web material showing the rows of tilde-slits configured in a direction parallel to the longitudinal axis. FIG. 6 illustrates the same thing. In both drawings, it must be noted that the tilde-slits are actual fine cuts in the web material. The difference between the two drawings is that in FIG. 5, the tilde cuts extend to the ends of the web material in the width direction. In FIG. 6, two "rails," 6, which are devoid of slits, run parallel to the longitudinal direction and are situated at the ends of the web material in the width direction. For the embodiment in FIG. 6, the two rails extend for the entire roll. The function of the rails is to make deployment by users easier. However, both configurations (i.e., of FIGS. 5 and 6) work equally well.

Figure 7A:
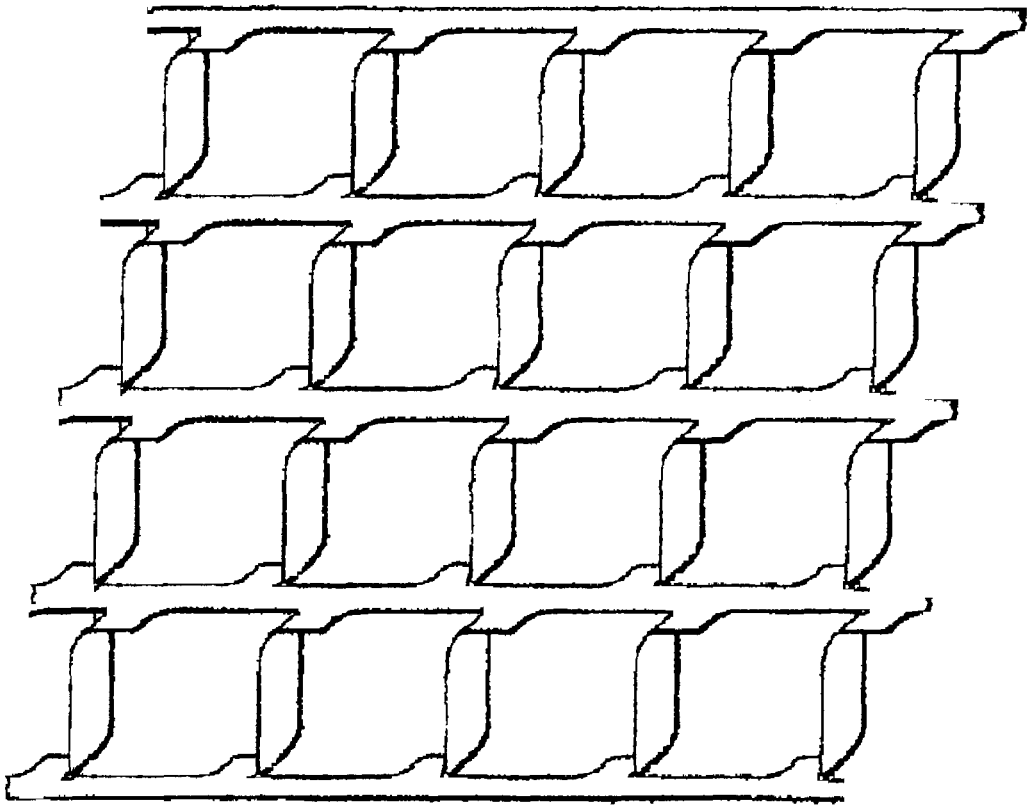
FIG. 7A shows a plan view of the expanded material.
Figure 7B:
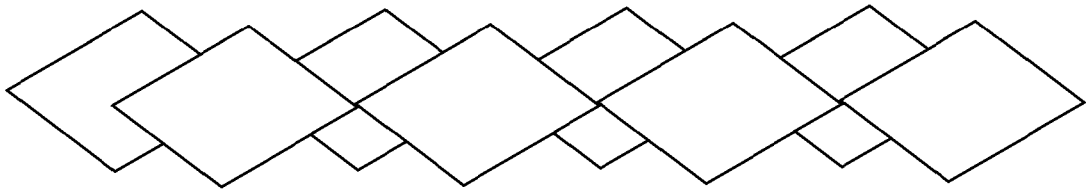
FIG. 7B shows an edge view of the expanded material.
Figure 8A:
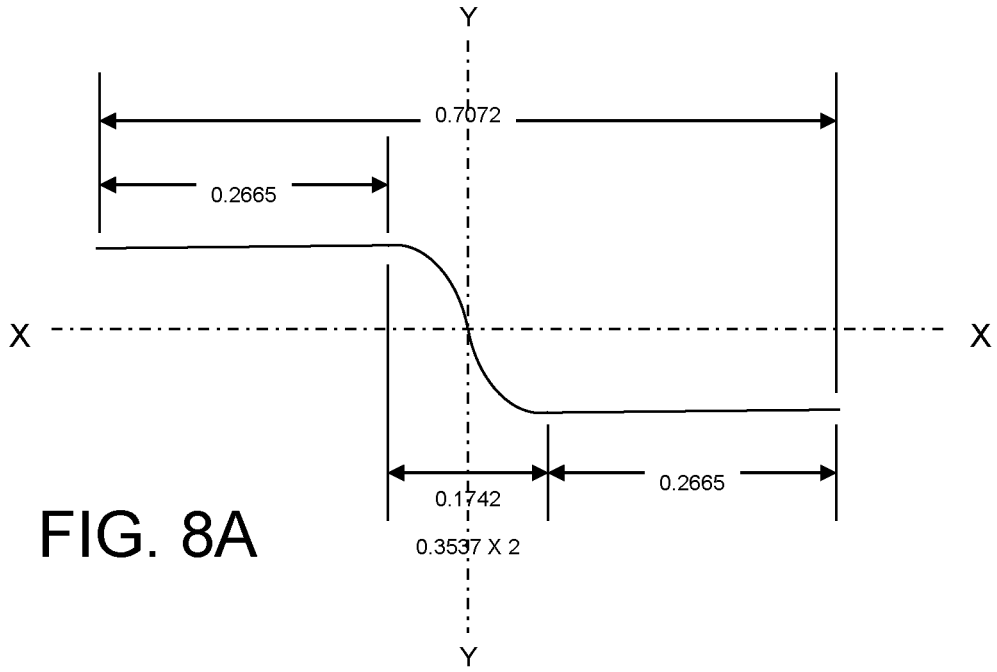
FIG. 8A shows the horizontal dimensions of a tilde-slit.
Figure 8B:
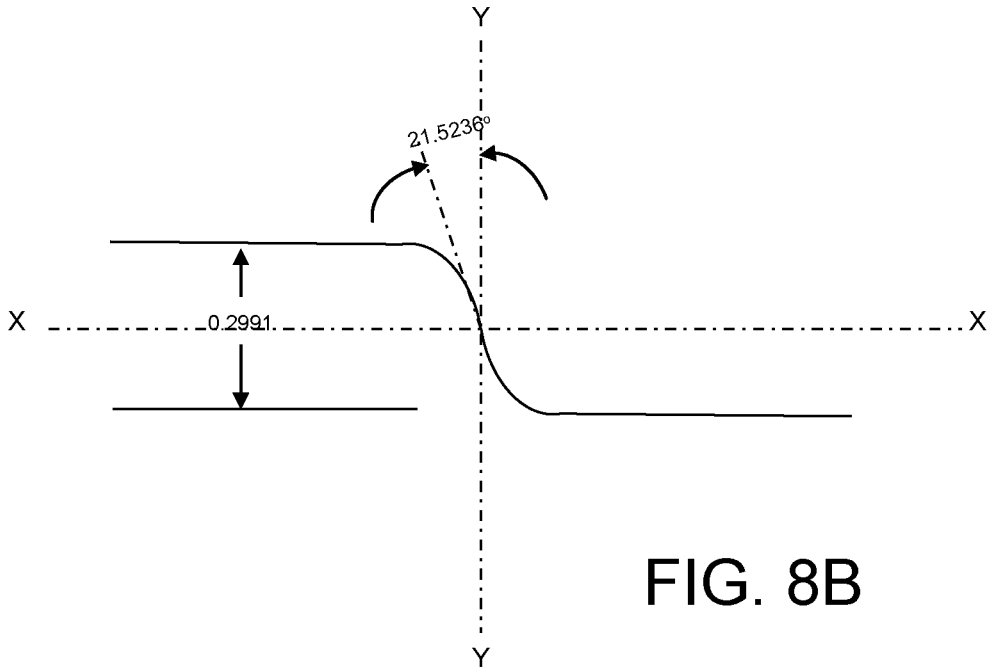
FIG. 8B shows the vertical and angle dimensions of the tilde-slit.
Figure 8C:
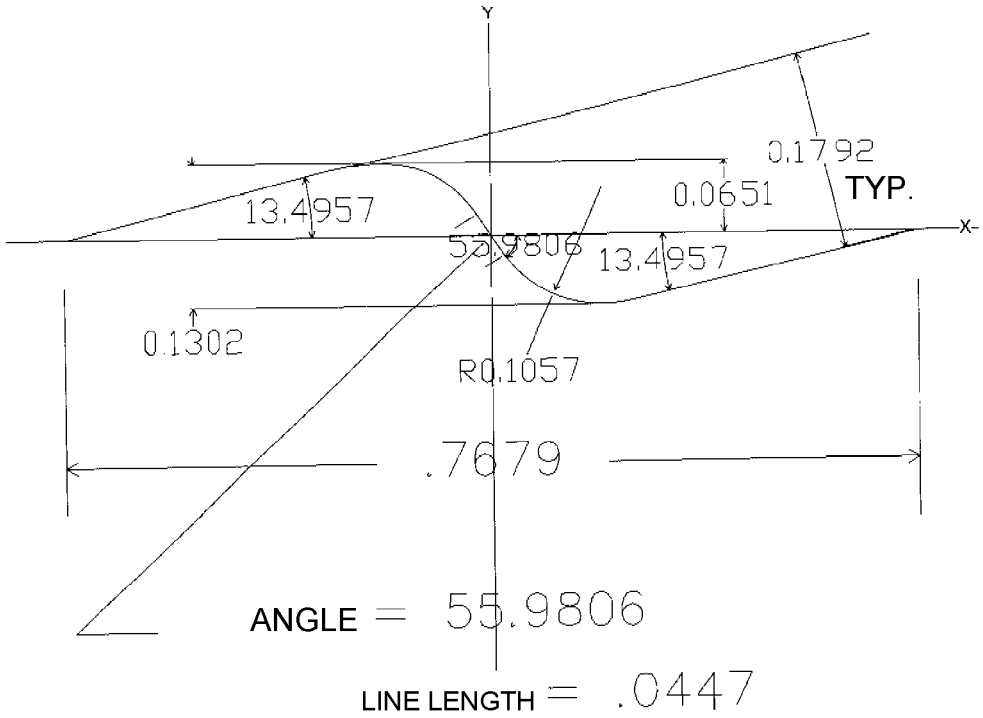
FIG. 8C shows dimensions of a tilde-slit cut at an angle to the horizontal.
Figure 8D:
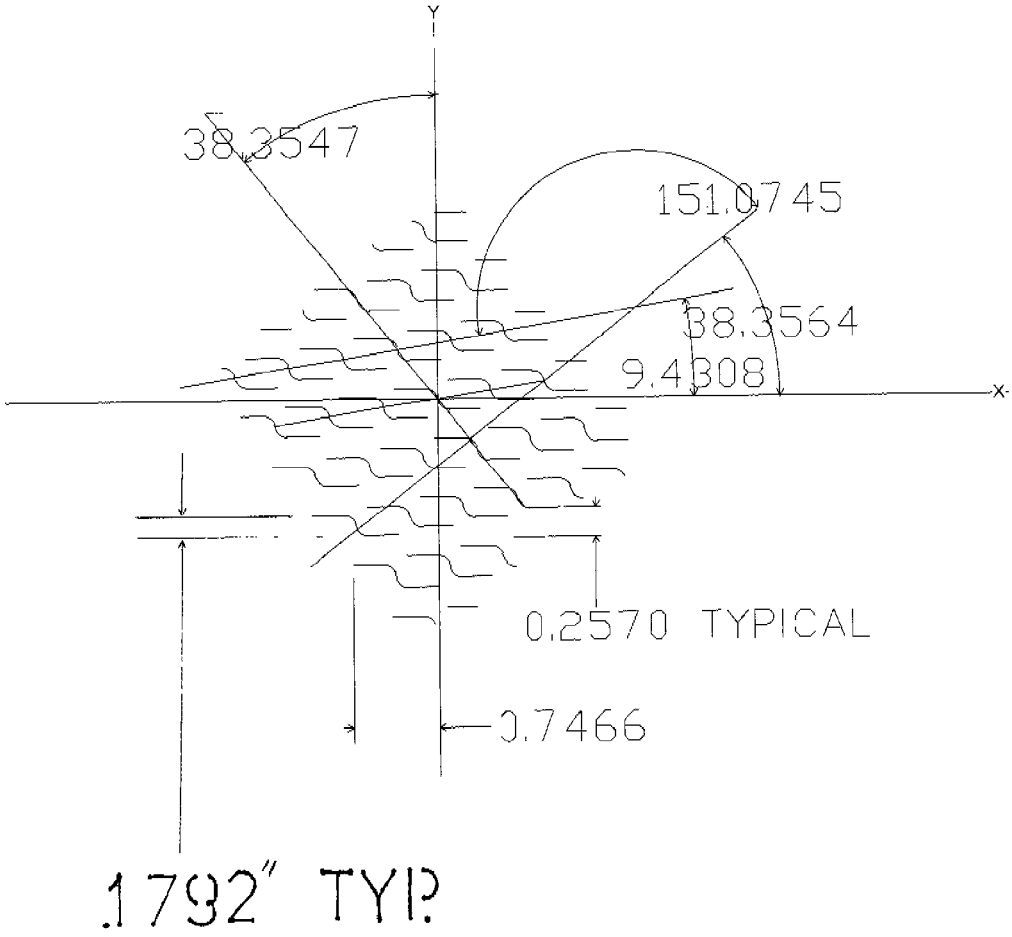
FIG. 8D shows dimensions of multiple adjacent rows of tilde-slits.
Figure 8E:
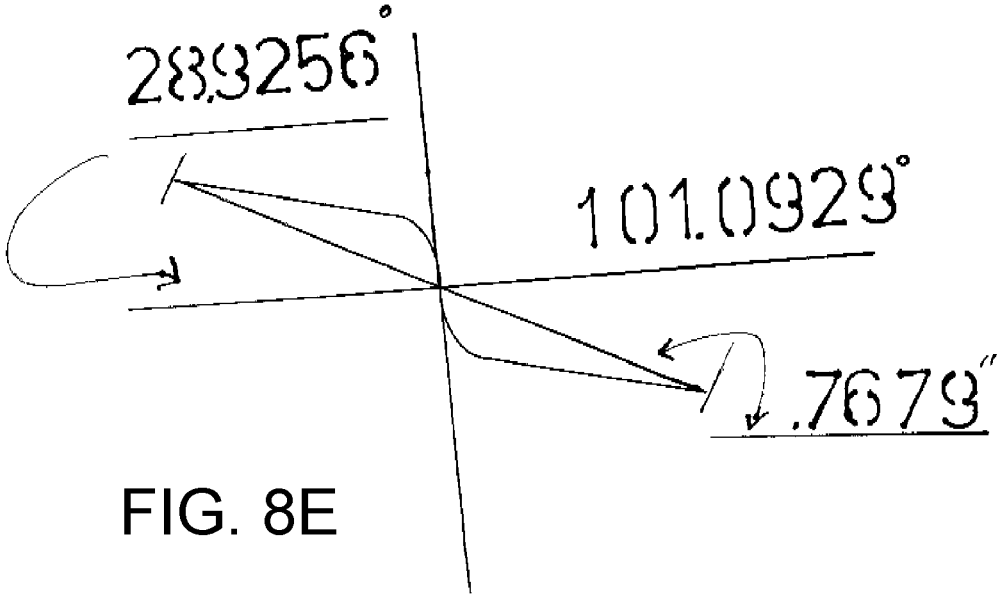
FIG. 8E shows dimensions of a single tilde-slit.
Figure 8F:
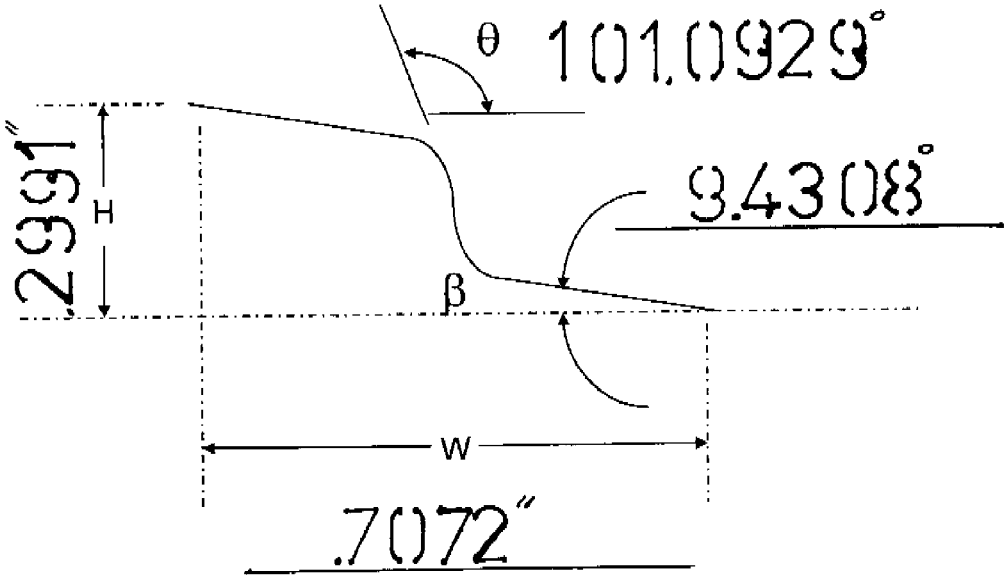
FIG. 8F shows dimensions of a single tilde-slit
Figure 8G:
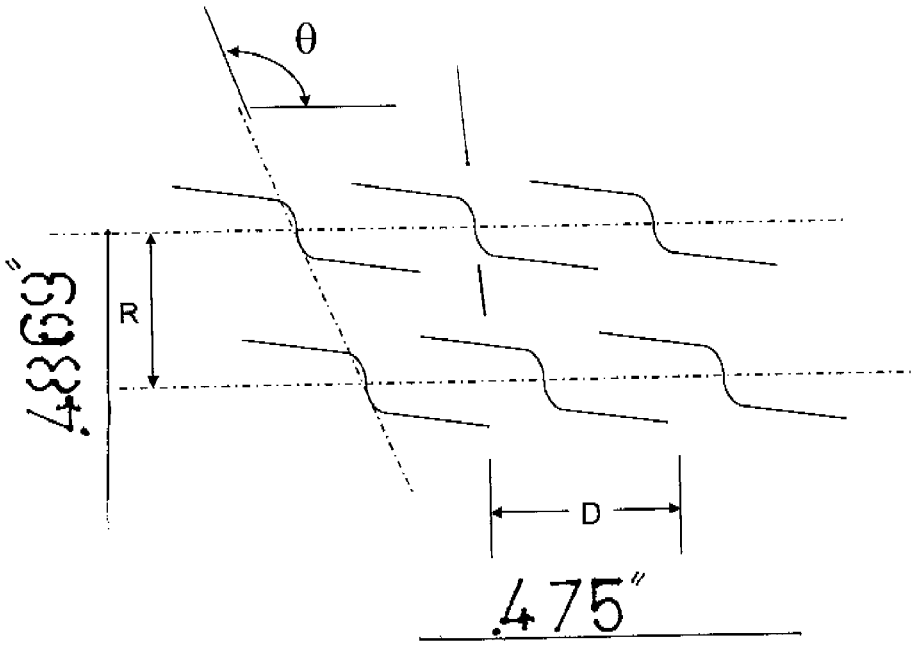
FIG. 8G shows dimensions of two adjacent rows of tilde-slits arranged along the longitudinal direction of the web material.
Figure 8H:
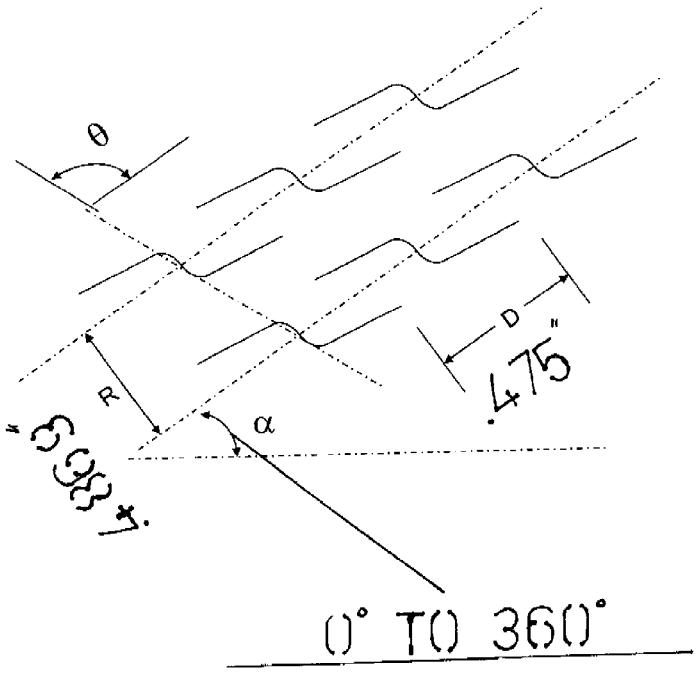
FIG. 8H shows dimensions of two adjacent rows of tilde-slits arranged at an angle to the longitudinal direction of the web material.
Figure 8J:
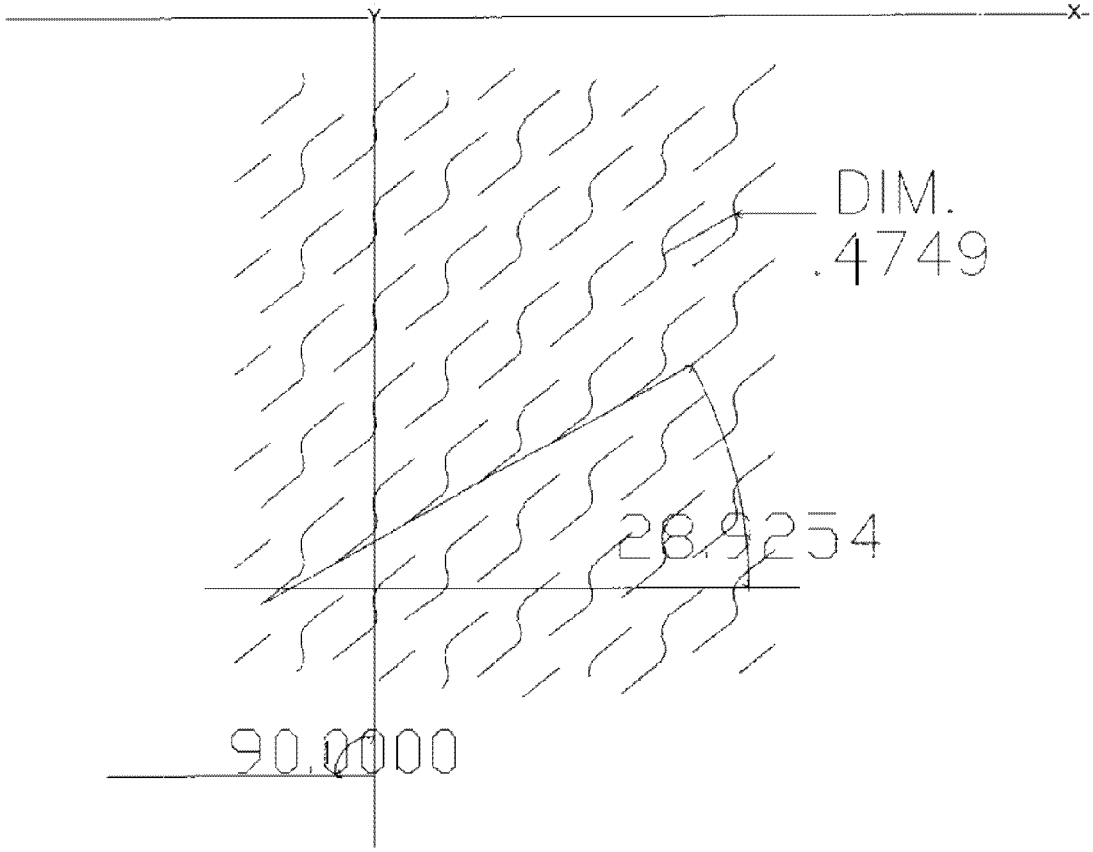
FIG. 8J shows dimensions of multiple adjacent rows of tilde-slits arranged at an angle to the longitudinal direction of the web material.

FIG. 7 illustrates how the web material appears when deployed. FIG. 7A is a plan view of the expanded webbing. Note the horizontal members and the vertical cross members. The cross members are twisted at their intersections with the horizontal members, thereby forming a three-dimensional structure. FIG. 7B is an edge view of the expanded webbing. Here the three-dimensional nature of the lattice structure is apparent. FIG. 7A shows the lattice voids as squares. They may also be rhombuses.

FIG. 8 shows dimensions of the variable parameters discussed supra for an exemplary embodiment. Refer to FIG. 8A. For this embodiment, the length of a tilde-slit, end-to-end, is 0.7072-inches. The length of each straight cut is 0.2665-inch, and the horizontal projected distance of the central portion is 0.1742-inches. FIG. 8B shows the total width of a tilde-slit to be 0.2991-inches, and the angle traversed by the central portion with the vertical Y-axis is 21.5236°. FIG. 8C shows dimensions of a tilde-slit cut at an angle to the horizontal. FIG. 8D shows dimensions of multiple adjacent rows of tilde-slits. FIG. 8E shows dimensions of a single tilde-slit. FIG. 8F shows dimensions of a single tilde-slit. FIG. 8G shows dimensions of two adjacent rows of tilde-slits arranged along the longitudinal direction of the web material. FIG. 8H shows dimensions of two adjacent rows of tilde-slits arranged at an angle to the longitudinal direction of the web material. FIG. 8J shows dimensions of multiple adjacent rows of tilde-slits arranged at an angle to the longitudinal direction of the web material.

Figure 9:
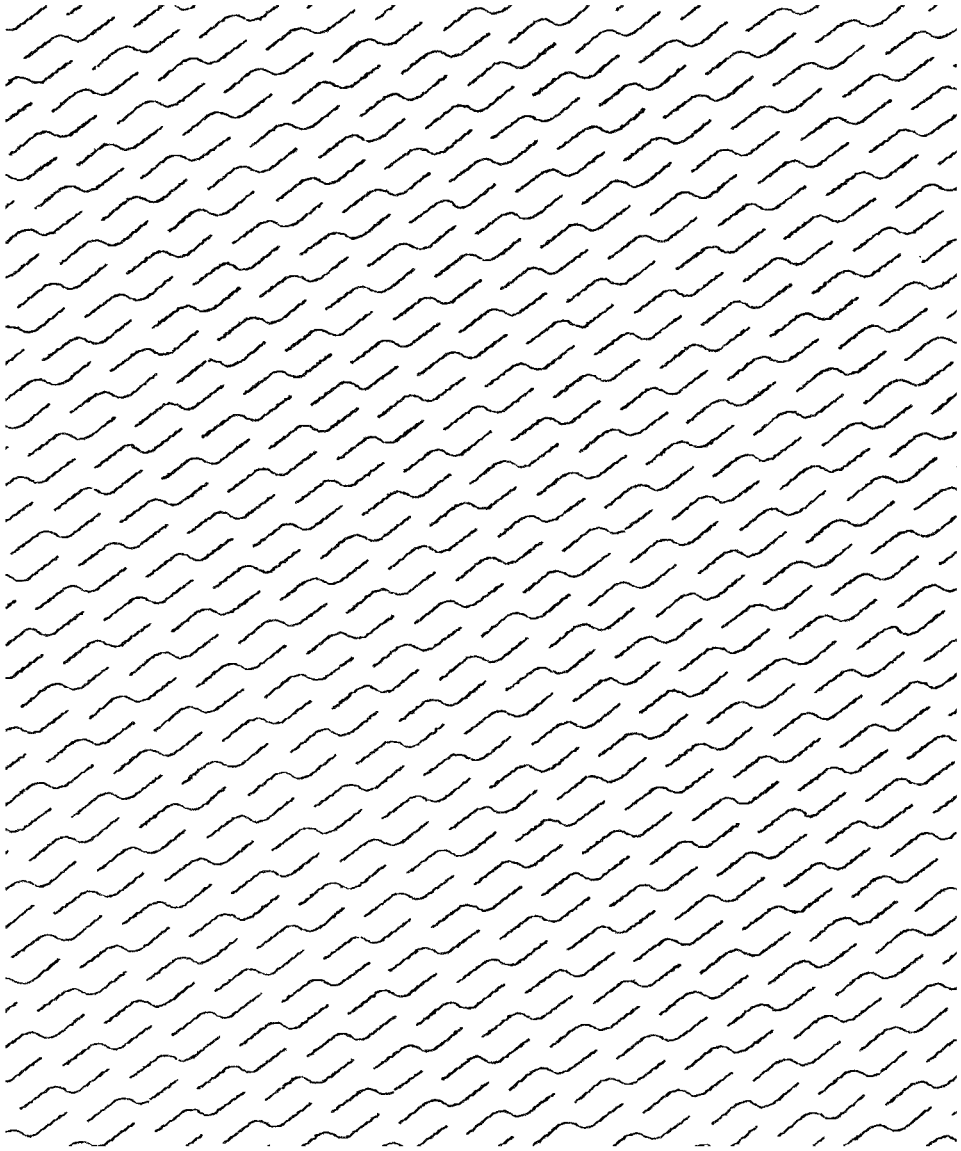
FIG. 9 illustrates a rectangular section of material with the rows of tilde-slits arranged at an angle to the longitudinal direction. With this material, the slits extend to the full width of the web.
Figure 10:
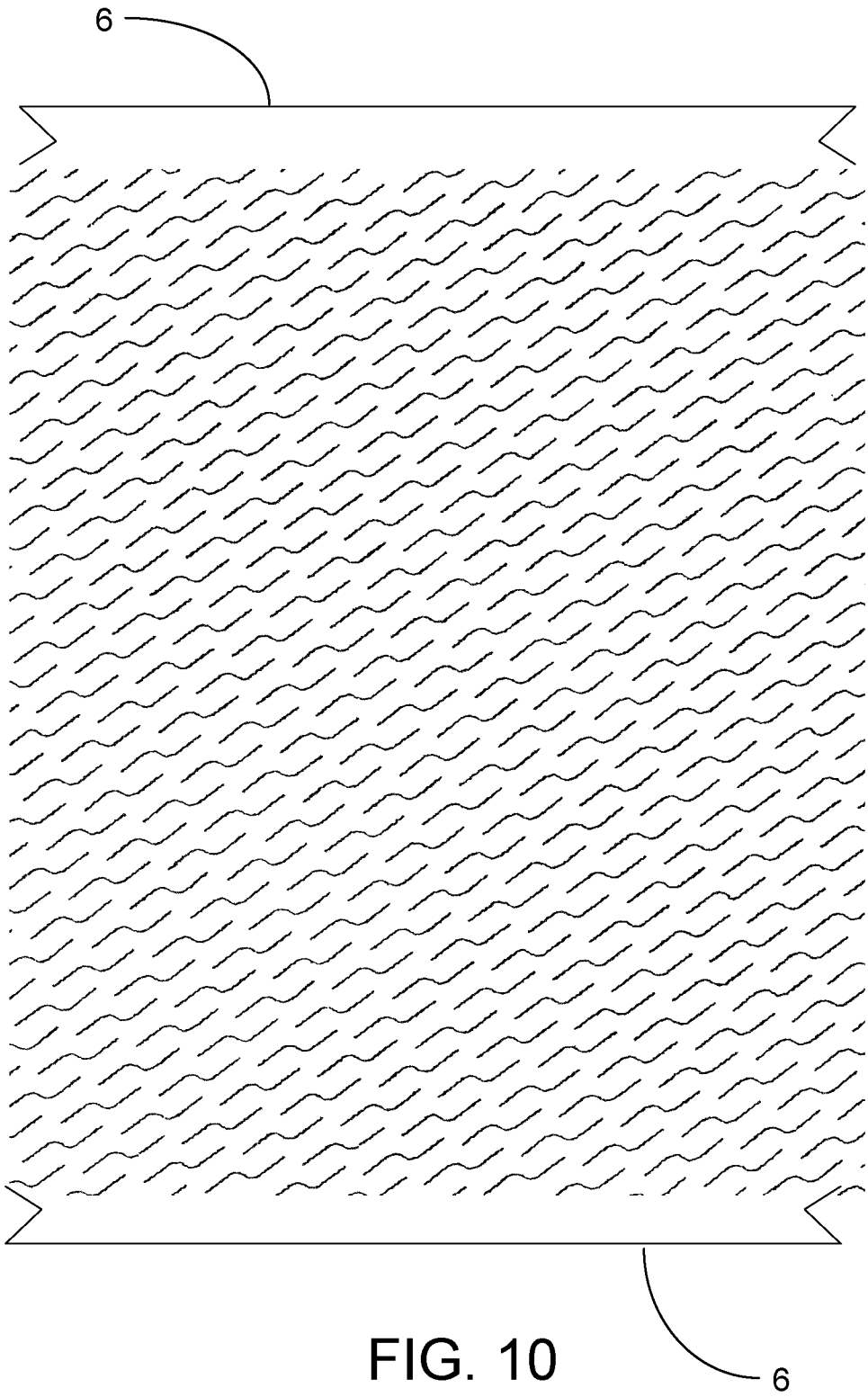
FIG. 10 illustrates a rectangular section of material with the rows of tilde-slits arranged at an angle to the longitudinal direction. With this material, two borders (devoid of slits) run parallel to the longitudinal direction and are positioned on both sides of the width of the web.

FIG. 9 illustrates a portion of the web material showing the rows of tilde-slits configured at an angle to the longitudinal axis. FIG. 10 illustrates the same thing. The difference between the two drawings is that in FIG. 9, the tilde-slit cuts extend to the ends of the web material in the width direction. In FIG. 10, two "rails," 6, which are devoid of slits, run parallel to the longitudinal direction and are situated at the ends of the web material in the width direction. For the embodiment in FIG. 10, the two rails extend for the entire roll. The function of the rails is to make deployment by users easier. However, both configurations (i.e., of FIGS. 9 and 10) work equally well.

The basic shape of the tilde-slit can vary, and is dependent upon the angle θ. That angle should be obtuse (i.e., >90°). A "Z" shaped cut tends to tear, and it does not allow for easy opening or expansion. While the curved sections 2 and 4 of FIG. 1 are not strictly necessary, rounded corners are preferred because such a cut provides a stronger structure when deployed. When used as a packing material, the use of rounded corners allow the subsequent folded sections of the lattice structure to fold more easily when the webbing is wrapped around an object.

The cross members form protrusions when the web material is expanded. Because of the three-dimensional nature of the web material, and the way that the material with these cuts expands, the resulting crushed material maintains a spring like elastic consistency. Randomly crushed material has a supporting characteristic, and it tends to be lightweight for its volume. The structure, when expanded and wrapped around an object tends to stay in place without tape or ties.

The cross member protrusions accomplish the following:

Upon expansion, the protrusion is created having a fold line. This fold line stiffens the protrusion and each side of the resulting lattice cell structure.

The protrusion is created on both sides of the web material, front and back, on opposite sides.

Due to the spring like elasticity, the protrusion adds resiliency to each cell and the entire lattice.

The protrusions help to allow the expanded web to nest or interlock cell to cell when wrapped around an object or itself. Some interlocking even occurs when the expanded structure is randomly crumpled upon itself.

The protrusions add depth, volume, rigidity, and nesting capabilities to this structure when expanded and put to use.

The web can be made from almost any material having a high to low flexibility as long as it can be formed. Suitable materials include, inter alia, paper, cardboard, plastic film, resinous materials, fibrous materials, or metals. Any material than can be cut and allowed to displace into the resulting shape with a minimal spring back could be considered. Materials having spring back characteristics might be considered if the structure is held open using mechanical stays.

The basic structure of the expanded web material described in the Present Application has the following useful functions:

as insulation;
as a cushioning or packing material;
as an absorbent filler for liquid spills;
as an expanded screen (hard or soft);
as a filter;
as a spacing element;
as a fire stop;
as a collating device;
as a crumple zone;
for heat transfer;
as a noise barrier;
as a net;
as a screen;
as a shade;
as a sieve;
as a mesh;
as an abrasive substrate;
as a soil stop for earth retention;
as a concrete or mason's cloth;
as a modeling armature;
etc.

The tilde-slits must be carefully designed. If not, the material could be difficult to deploy. Possible results are:

The web will not expand.

The web will expand partially, not evenly, or will tear.

The web will expand with an uneven lattice pattern.

The web will expand with an uneven depth in the third dimension.

The force required to expand the web will vary along the length of the web.

Accordingly, the web material of the embodiment shown in FIG. 8, and disclosed supra, yields excellent results when expanded. The dimensions in this embodiment are scalable in that selection of parameter dimensions that produce a geometrically similar tilde-slit pattern would also yield excellent results when expanded. However, other patterns are possible. By varying the parameters, rectangular or parallelogram shaped voids may be created having different dimensions in the longitudinal direction than the width direction.

From our previous discussion of the embodiments of FIGS. 5, 6, 9, and 10, we discern that the outside rails that run longitudinally along the entire length of the web material are unnecessary. This is distinguished from the web material in the Fence Tape Patent where the rails are necessary to keep the fence from tearing apart when deployed. However, outside rails provide a grasping region that can be useful to help a user expand the web. The tilde-slit pattern can also be arranged so that, if desired, web expansion closer to the longitudinal centerline is greater than the expansion closer to the outside rails. This would allow a more controlled expansion of the web material. The result would be a distended center most section that is longer than at the ends. Here, the material would bow out to create a deeper three-dimensional structure.

I claim:

1. A web material having a longitudinal direction and dimension, a width direction and dimension, a top surface, a bottom surface, and at least two edges that are boundaries of the width dimension, said web material comprising a plurality of rows of tilde-slits, wherein:

a) the tilde-slits are cut extending from the top surface to the bottom surface;

b) the tilde-slits are all congruent;

c) each tilde-slit when unexpanded is a slit that consists essentially of:

two essentially parallel end portions separated by a center portion transverse to the end portions, the center portion further comprising a center point, wherein when a tensile force is applied on the web material the tilde-slits expand to form voids within the web material, d) each row of tilde-slits comprising a plurality of tilde slits wherein their center points all lie along a straight centerline;

e) the centerlines of the plurality of rows of tilde-slits being essentially parallel to each other;

f) the end portions of the tilde-slits in a row being not parallel to the centerlines;

g) the center point of any tilde-slit in a given row being positioned relative to the center point of the nearest tilde-slit in an adjacent row along a transversal intersecting the essentially parallel centerlines of the adjacent rows, wherein said transversal is not perpendicular to the essentially parallel centerlines;

h) a second transversal extending coincident to said center point of the tilde-slit in an adjacent row and intersecting said transversal at an angle $\alpha$ to the longitudinal direction (x-axis), wherein the second transversal is not parallel to the longitudinal direction (x-axis) so that the tilde slit rows are offset;

i) when said transversal is extended in any direction, and thus intersects the essentially parallel centerlines of the adjacent rows, the center point of a tilde-slit will coincide with the intersection of the transversal with every essentially parallel centerline;

j) wherein each unexpanded tilde-slit further consists essentially of two curves that each connect an end portion to the center portion, wherein the two curves are double reversed mirror images of one another, such that the tilde-slit becomes a continuous figure formed by joining one end portion to one curve, and that one curve to the center portion, and the center portion to the second curve, and the second curve to the second end portion.

2. The web material of claim 1, wherein the longitudinal dimension is substantially larger than the width dimension.

3. The web material of claim 2, wherein said web material is rolled along the longitudinal dimension to form a cylinder the height of which is the width dimension of the web material, and the diameter of which is determined by an outer dimension of a spiral having a perimeter equal to the longitudinal dimension of the web material.

4. The web material of claim 1, wherein the centerlines of the plurality of essentially parallel rows of tilde-slits are parallel to the longitudinal direction.

5. The web material of claim 4 further comprising two regions, wherein:

a) each region is located at an opposite edge;
b) each region has a regional width along the width direction of the web material;
c) each region has an edge that is coincident with the edge of the web material;
d) each region extends in the longitudinal direction along the entire longitudinal dimension; and
e) neither region contains tilde-slits.

6. The web material of claim 1, wherein the centerlines of the plurality of essentially parallel rows of tilde-slits are not parallel to the longitudinal direction.

7. The web material of claim 6 further comprising two regions, wherein:

a) each region is located at an opposite edge;
b) each region has a regional width along the width direction of the web material;
c) each region has an edge that is coincident with the edge of the web material;
d) each region extends in the longitudinal direction along the entire longitudinal dimension; and
e) neither region contains tilde-slits.

8. The web material of claim 1 wherein a tensile force on the material causes the material to expand to create a lattice of square, rectangular, rhombus, or parallelogram shaped voids enclosed within the web material.

9. The web material of claim 8 wherein, upon expansion, some of the web material twists as to form protrusions that protrude in a direction not coincident with either the top or bottom surfaces of the web material, thereby imparting to the expanded web material a thickness and forming an irregular depth dimension of the expanded web material.

10. The web material of claim 9 wherein, if the web material is crumpled or folded on itself, the protrusions and the voids interlock to form a layered elastic material that once compressed, springs back upon release.

11. The web material of claim 8, wherein the essentially parallel rows of tilde-slits are configured such that the web material expands only in the width direction.

12. The web material of claim 8, wherein the essentially parallel rows of tilde-slits are configured such that the web material expands only in the longitudinal direction.

13. The web material of claim 8, wherein the essentially parallel rows of tilde-slits are configured such that the web material expands in both the longitudinal direction and the width direction.

14. The web material of claim 8, wherein the essentially parallel rows of tilde-slits are configured such that the web material expands non uniformly at different regions of the web material to produce a non-planar lattice.

15. The web material of claim 1 produced from a material taken from the group consisting of plastic webbing, paper, cardboard, resinous material, fibrous material, and metal.

16. The web material of claim 1 wherein the center portions of the tilde-slits are not perpendicular to the end portions.

17. A web material having a longitudinal direction and dimension, a width direction and dimension, a top surface, a bottom surface, and at least two edges that are boundaries of the width dimension, said web material comprising a plurality of rows of tilde-slits, wherein:

a) the tilde-slits are cut extending from the top surface to the bottom surface;
b) the tilde-slits are all congruent;
c) each tilde-slit when unexpanded is a slit that consists essentially of:
   two essentially parallel end portions separated by a center portion transverse to the end portions,
   the center portion further comprising a center point,
   wherein when a tensile force is applied on the web material the tilde-slits expand to form voids within the web material,
d) each row of tilde-slits comprising a plurality of tilde slits wherein their center points all lie along a straight centerline;
e) the centerlines of the plurality of rows of tilde-slits being essentially parallel to each other;
f) the end portions of the tilde-slits in a row being not parallel to the centerlines;
g) the center point of any tilde-slit in a given row being positioned relative to the center point of the nearest tilde-slit in an adjacent row along a transversal intersecting the essentially parallel centerlines of the adjacent rows, wherein said transversal is not perpendicular to the essentially parallel centerlines;
h) a second transversal extending coincident to said center point of the tilde-slit in an adjacent row and intersecting said transversal at an angle $\alpha$ to the longitudinal direction (x-axis), wherein the second transversal is not parallel to the longitudinal direction (x-axis) so that the tilde slit rows are offset;
i) when said transversal is extended in any direction, and thus intersects the essentially parallel centerlines of the adjacent rows, the center point of a tilde-slit will coincide with the intersection of the transversal with every essentially parallel centerline;
j) wherein the transversal of (g) forms an angle $\theta$ on the longitudinal direction (x axis), and said angle $\theta$ is greater than 90°.

18. A flat planar formable surface having thru cuts that are off-angle to their longitudinal direction while maintaining a centerline on the mid-section of the cut that is aligned as a transversal at an angle greater than 90 degrees with respect to the longitudinal direction and will only deform into a three dimensional structure that is essentially flat having substantially square or rhombi or diamond shaped cells or cubicles that are formed by opening and folding of the formable surface and are attached at their corners in the x and y axis while concurrently these cells when being born are attached to longitudinal rails having peaks and valleys that are off angle to the horizontal plane so that said cells can only be opened to the limitation of a predetermined precut structure by applying a force to said planar surface thus opening the cells into an array.

* * * * *